US006305414B1

(12) United States Patent
Kozinski

(10) Patent No.: US 6,305,414 B1
(45) Date of Patent: Oct. 23, 2001

(54) VARIABLE FLOW AREA REFRIGERANT EXPANSION DEVICE

(76) Inventor: Richard C. Kozinski, 27671 Dowland, Warren, MI (US) 48092

( * ) Notice: Subject to any disclaimer, the term of this patent is extended or adjusted under 35 U.S.C. 154(b) by 0 days.

(21) Appl. No.: 09/724,209

(22) Filed: Nov. 28, 2000

Related U.S. Application Data

(60) Provisional application No. 60/203,361, filed on May 10, 2000.

(51) Int. Cl.[7] ..... F16K 31/122; F25B 41/06

(52) U.S. Cl. ..... 137/504; 137/497; 138/46; 62/528

(58) Field of Search ..... 137/494, 497, 137/504; 138/46; 62/528

(56) References Cited

U.S. PATENT DOCUMENTS

| | | | |
|---|---|---|---|
| 3,421,542 | 1/1969 | Adams et al. | 137/504 |
| 4,009,592 | 3/1977 | Boerger | 62/222 |
| 4,375,228 | 3/1983 | Widdowson | 138/46 |
| 4,856,292 | 8/1989 | Kawai et al. | 137/494 |
| 4,951,478 | 8/1990 | McDonald | 137/504 |
| 5,081,847 | 1/1992 | Anderson, Jr. | 62/222 |
| 5,134,860 | 8/1992 | Drucker | 137/513.3 |
| 5,170,638 | 12/1992 | Koenig et al. | 62/204 |
| 5,894,741 | 4/1999 | Durham et al. | 62/528 |
| 5,901,750 | 5/1999 | Kozinski | 138/45 |

*Primary Examiner*—John Rivell
*Assistant Examiner*—Ramesh Krishnamurthy
(74) *Attorney, Agent, or Firm*—Rader, Fisman & Grauer, PLLC

(57) ABSTRACT

A refrigerant flow metering device for use in a refrigeration system which uses a movable piston with a fixed flow passage in series with a variable area flow passage. The variable flow area is defined by the position of the piston relative to the valve body. The position of the movable piston is a function of refrigerant pressure differential across the piston and the force of a spring member acting in an opposite direction on the piston. In one embodiment, the variable flow area is defined as the clearance between a tapered fixed housing and a tapered portion of the movable piston. In an alternative embodiment, the metering device includes a two-piece piston having a re-open feature that increases the inlet orifice diameter of the piston.

20 Claims, 6 Drawing Sheets

VARIABLE FLOW AREA REFRIGERANT EXPANSION DEVICE

REFERENCE TO RELATED APPLICATIONS

This application claims the benefit of U.S. Provisional Application No. 0/203,361, filed May 10, 2000, the disclosures of which is incorporated by reference herein in its entirety.

FIELD OF THE INVENTION

The invention relates generally to variable flow metering devices and more particularly to an improved variable flow area refrigerant expansion devices for use in controlling compression refrigeration systems so as to be responsive to a pressure differential between high and low pressure areas of a refrigeration system.

BACKGROUND OF THE INVENTION

Most small commercial vehicles and particularly automotive and mobile air conditioning systems utilize a fixed area refrigerant expansion device for flow control to reduce or eliminate moving parts and reduce costs. Known fixed area expansion devices are long capillary tubes or relatively short orifice tubes in the high-pressure liquid line between the condenser and evaporator. The refrigerant flow is primarily dependent on the inlet pressure (head pressure) at the orifice and the amount of liquid subcooling. In fixed area expansion devices, increasing head pressure or subcooling increases flow while increasing gas at the inlet decreases flow. Suction pressure changes have no effect on flow in normal system operation at higher ambient since flow is at "sonic" velocity and suction pressure is usually below the pressure at which this sonic flow occurs. As described in detail in my U.S. Pat. No. 5,901,750, incorporated herein by reference, these characteristics make the fixed area expansion device or capillary tube self regulating and produces adequate performance in a wide range of conditions encountered in normal automotive air conditioner operation with the exception performance at idle. In automotive use the fixed orifice tube is sized for high ambient load at high speed vehicle operation and is generally about twice as large at idle as is optimal, resulting in increased compressor horsepower and a reduction in cooling.

Another known expansion device for use flow control in refrigerant systems is a thermostatic expansion valve. A thermostatic expansion valve is a variable area expansion device and operates to control the flow rate of liquid refrigerant entering the evaporator as a function of the temperature of the refrigerant gas leaving the compressor. However, while fixed area devices cannot match the efficiency of the thermostatic expansion except at certain defined operating conditions, thermostatic expansion valves are more complicated to manufacture and thus, more costly than the fixed devices.

An example of an automotive refrigerant system operation at high vehicle operation speed as compared to vehicle idle is as follows: At high operation speeds the head pressure may be approximately 250 PSIG and the sub-cooling temperature 20° F. with a system capacity of approximately 24,000 BTU/Hr. At idle the head pressure of the vehicle rises to 350 PSIG due to reduction of condenser air flow and re-circulation of hot under-hood air into the condenser. Accordingly, balance is achieved at idle by reducing sub-cooling at the expansion device inlet. Initially, the rise in head pressure increases flow through the orifice tube. The result is that the sub-cooled liquid in the condenser is flushed out and uncondensed gas enters the orifice tube inlet. Gas greatly reduces flow until the flow rate out of the compressor is equal to flow through the orifice tube. Since capacity per pound of refrigerant is a function of liquid percentage after expansion, a gaseous mixture entering the expansion device greatly reduces capacity and system efficiency. At idle this capacity reduces to 12,000 BTU/Hr. in this example. If a smaller flow area is utilized in the expansion device refrigerant flow is reduced allowing liquid backup in the condenser and thus sub-cooling to occur. The net result is more cooling at reduced compressor work.

However, when small orifice are used at high load high speed operational conditions, more refrigerant is required in the system as more back up of liquid occurs until enough subcooling and head pressure are available to again flow enough to satisfy evaporator requirements. Unfortunately, this causes the head pressure to rise in the range of 300–400 PSIG, substantially reducing the compressor life. Accordingly, the variable flow orifice must not be engaged into the minimum flow area at high speed high load conditions, in order to operate satisfactory.

Further, a very short orifice tube relative to it's diameter becomes more restrictive as sub-cooling is increased. This characteristic of the short orifice tube is a detriment in automotive use since flow starvation may occur at high vehicle operational speeds if the small orifice size is engaged. Starvation results in high compressor discharge superheat temperatures, which may be very detrimental to compressor durability.

SUMMARY OF THE INVENTION

In accordance with the invention, a variable flow area refrigerant expansion device includes a valve body having an axially extending aperture therethrough, a piston slidably received in the valve body aperture, and a spring member operatively connected to the piston to resiliently urge the piston in a predetermined direction in the valve body aperture to insure fluid flow through the expansion device. The valve body aperture includes an inlet end and an outlet end. In accordance with one aspect of the invention, the section of the interior surface of the valve body aperture at the outlet end is tapered at a predetermined angle from a first diameter to a second diameter, wherein the first diameter is smaller than the second diameter, and terminates in a flow channel. The flow channel is a preferably a cross-bore.

The piston includes a flow passageway partially extending therethrough, with an inlet end and an outlet end. The outlet end terminates in a cross-bore formed though the piston body. In accordance with the invention, the piston further includes a metering member having a tapered portion and a straight section positioned downstream from the direction of fluid flow through the expansion device. The tapered portion is tapered to a predetermined angle and has a first end defined by a first diameter and a second end defined by a second diameter, where the first diameter is larger than the second diameter. The piston is positioned within the valve body aperture with the tapered portion of the piston being received adjacent to the outlet end of the valve body, upstream of said tapered section of said valve body when said piston is in an open position. In a preferred embodiment the tapered portion of the piston is tapered to a first predetermined angle and the tapered section of the valve body is tapered to a second predetermined angle such that the tapers are not parallel to provide a mechanism for metering fluid through the expansion valve in response to pressure differentials between the inlet and outlet ends of the valve body.

The spring member is disposed in a spring chamber formed in the valve body downstream of the flow channel. A piston spring guide extends outwardly from the piston and engages the spring member to resiliently urge the spring into a full open position.

In accordance with another aspect of the invention, to insure that fluid flows through the passageway in the piston, it is preferred that the device include at least one valve body seal and at least one piston seal member. An outer surface of the valve body is preferably formed with an annular groove to receive a valve body seal, such as an O-ring A second annular groove and valve body seal are preferably proved as a back-up seal, downstream of the first annular groove.

The interior surface of the valve body inlet end is preferably provided an annular surface for engaging piston seal member. In a preferred embodiment, the expansion device further includes a screen member that is connected to the inlet end of the valve body. A distal end of the screen member cooperates with the annular shoulder provided on the interior surface of the valve body such that the piston seal member is captured therebetween, thereby reducing the requirement for rigid tolerances to adequately retain piston seal member. Alternatively, the interior surface of the valve body may include an interior annular groove for retaining the piston seal member, or the inlet end of the piston may be provided with an annular groove for receiving the piston seal member.

In accordance with another aspect of the invention, it is preferred that a screen member is connected to the valve body by a snap-fit connection. Accordingly, the screen member is preferably provided with outwardly extending tang members that engage recesses formed in the interior surface of the valve body inlet end. Alternatively, the screen member may be molded onto the inlet end of the valve body or threadedly connected thereto.

During operation, as the piston moves due to fluid pressure, from the open position to a metering position, the tapered portion of the piston generally aligns with the tapered section of the valve body. Due to the different tapering angles, the fluid is metered to the flow channel.

An alternative embodiment of a two-piece piston expansion valve is also disclosed. The two piece piston expansion valve includes a valve body having an axially extending aperture partially extending therethrough, a two piece piston having first and second piston members and a spring member. The valve body aperture includes an inlet end and at least one flow channel. A portion of the inner surface of the valve body is tapered to a predetermined angle.

The first piston member has a flow passageway extending therethrough with an inlet end and an outlet end. The first piston member is preferably U-shaped such that the outlet end of the first piston member has a diameter larger than the diameter of the inlet end. The second piston member has a mating end that is selectively receivable within the outlet end of the first piston member when the two-piece piston is in an open position. The second piston member further has an elongated tapered end portion that terminates in a generally cylinderical end portion. Preferably, the mating end of the second piston member further includes at least one flow channel formed therein.

The two piece piston is positioned within the valve body aperture such that the tapered portion of the second piston member is generally aligned with the tapered section of the interior surface of the valve body. A piston spring guide extends outwardly from the cylindrical end portion of the second piston member into a spring chamber formed in the valve body to engage with the spring member. The spring member resiliently urges the piston into the open position.

Preferably, to insure that fluid flows through the passageway in the piston, the device further include at least one valve body seal and at least one piston seal member. An outer surface of the valve body is preferably formed with an annular groove to receive a valve body seal, such as an O-ring. A second annular groove and valve body seal are preferably provided as a back-up seal, downstream of the first annular groove.

The interior surface of the valve body inlet end is also preferably provided an annular surface for engaging piston seal member. In a preferred embodiment, the expansion device further includes a screen member that is connected to the inlet end of the valve body. A distal end of the screen member cooperates with the annular shoulder provided on the interior surface of the valve body such that the piston seal member is captured therebetween, thereby reducing the requirement for rigid tolerances to adequately retain piston seal member. Alternatively, the interior surface of the valve body may include an interior annular groove for retaining the piston seal member, or the inlet end of the piston may be provided with an annular groove for receiving the piston seal member.

During operation, in response to a predetermined pressure differential, the first and second piston members move downstream, away from the inlet of the valve body. The first member contacts an annular shoulder formed in the valve body, stopping the movement of the first member. The second member continues downstream, aligning the tapered portions of the second piston member and the interior surface of the valve body until spring member limits the movement of the second piston member. Fluid is metered between the tapered sections out of the flow channel. Preferably, the flow channel is radiused to reduce noise during operation.

In an alternative embodiment, the cylindrical end portion if further provided with an inwardly extending flow groove. In the open position, flow groove is positioned upstream of the flow channel As the second piston member moves downstream, the flow groove aligns with the flow channel to provide greater clearance between the flow channel and the second piston member to reduce pressure downstream of the tapered portion of the second piston member. Due to the greater clearance, the second piston member is permitted to move at lower inlet pressures.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

Figure 1:
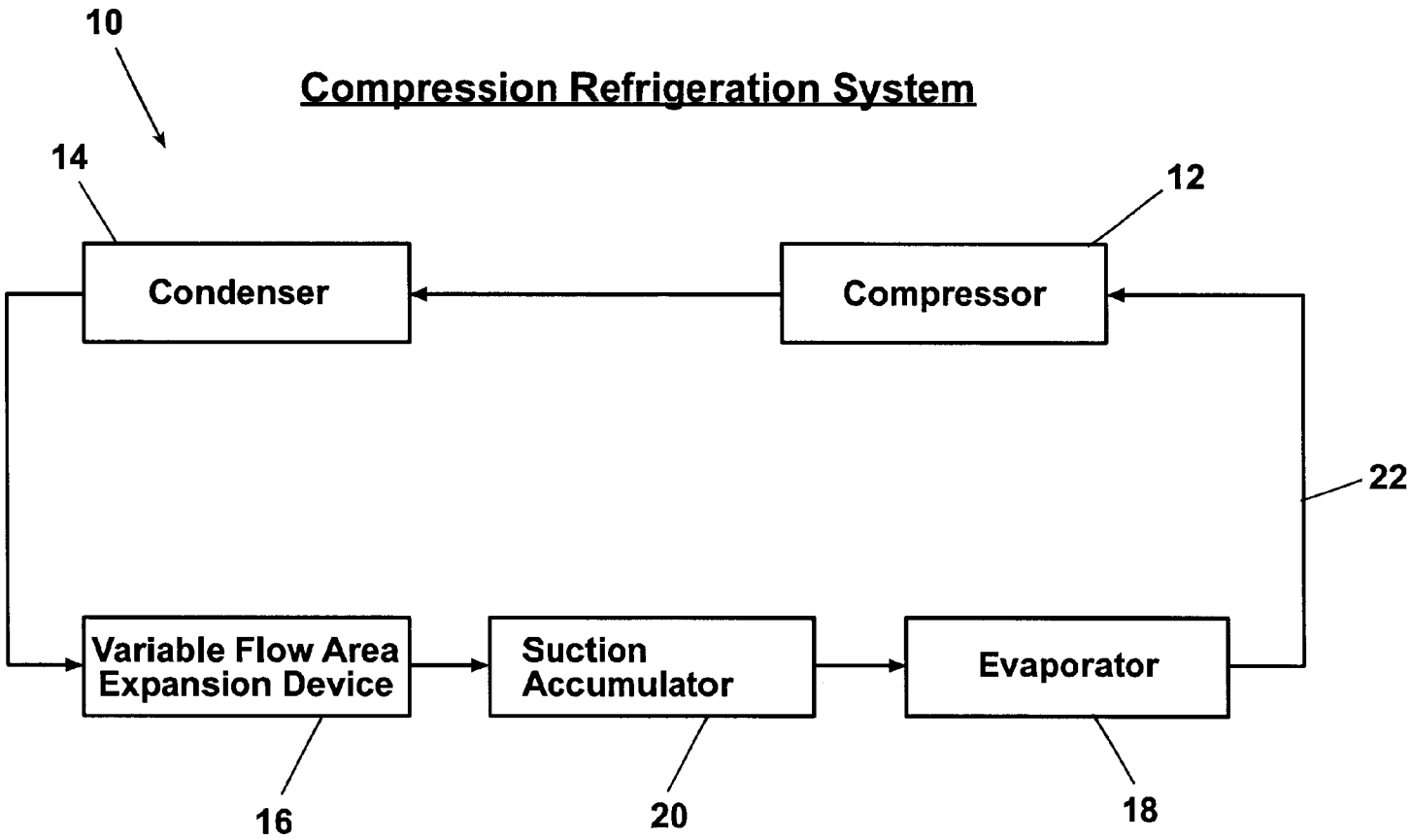
FIG. 1 is a schematic diagram of a compression refrigeration system utilizing a variable flow area refrigerant expansion device in accordance with the present invention.

Referring to FIG. 1, a compression refrigeration system 10 is shown. System 10 is typical of that found in many air conditioning applications especially in automotive use. System 10 includes a compressor 12, a condenser 14, an expansion device 16, and an evaporator 18. In a preferred embodiment, system 10 further includes an optional suction accumulator 20. Suction accumulator 20 is desirable in highly variable air conditioning load applications for storing refrigerant, to prevent compressor slugging and to allow refrigerant to be displaced from low pressure and high pressure areas. The components of system 10 are connected together by refrigerant lines to form a refrigerant circuit. In operation, compressor 12 is driven by a vehicle engine (not shown) and compresses refrigerant vapor to a temperature above the ambient condenser air temperature. Refrigerant is delivered from compressor 12 as high pressure vapor to an inlet of condenser 14 by a compressor discharge line (not shown). The condenser 14 removes heat from this vapor in a conventional manner and condenses all or most of this vapor to a liquid. This high-pressure refrigerant then is discharged as high pressure refrigerant liquid to a high-pressure liquid line 22 that is fluidly connected to the evaporator 18. The expansion device 16 of the present invention is positioned within liquid line 22 between condenser 14 and evaporator 18.

Once fluid flows to expansion device 16, it is expanded to a low-pressure mixture of liquid and gas. This mixture flows to evaporator 18 where most or the entire liquid portion is evaporated as heat is absorbed from an external heat source such as relatively warm humid air. In automotive applications the refrigerant vapor along with oil and a small percentage of liquid flows then to suction accumulator 20 where all of the vapor and again a small percentage of liquid is metered back to compressor 12 where the cycle is repeated.

Referring to FIGS. 2–5, expansion device 16 will be described in greater detail. Expansion device 16 consists of a valve body 24, a screen assembly 26, a piston 28, piston sealing member 30, spring member 31 and at least one expansion device sealing member 32. The device is shown positioned in line 22, wherein line 22 further includes crimped portions 34 that extend radially inwardly to keep expansion device 16 in place within line 22.

Screen assembly 26 is positioned at and operatively connected to an inlet end 36 of valve body 24 by means of an annular snap-fit end portion 38. End portion 38 includes upwardly extending tang members 40 that engage an annular groove 42 formed within an internal surface 44 of valve body 24. While a snap-fit connection is preferred to operatively connect screen assembly 26 to valve body 24, other suitable connection members may be employed, such as threaded connections.

Valve body 24 is generally hollow with a cylindrical outer surface 44 and having stepped sections with varying outer diameters. A first section 46 at inlet end 36 of valve body 24 has the largest diameter $D_1$ that is sized to closely fit within line 22 and is open to receive piston 28, as explained in further detail below. First section 46 terminates at annular surface 48 which abuts against crimped portions 34 to retain valve body 24 within line 22. Outer surface 44 of first section 46 includes at least one annular groove 50 formed around thereof to receive expansion device sealing member 32. Preferably, sealing member 32 is an O-ring, although other suitable sealing members may be employed. To insure against refrigerant flowing around expansion device 16 in the event of a failure of sealing member 32, in the preferred embodiment, there is a second expansion device sealing member **32*a* positioned within a second annular groove 50*a* downstream of sealing member 32. A second section 52 of valve body 24 has at least two flow aperture 54 formed therethrough to permit fluid to flow through expansion device 16, to be explained in further detail below. Spring member 31 is positioned in a third section 55 of valve body 24**.

Piston 28 is movably positioned within valve body 24. Piston 28 has a first cylindrical end portion 56, a central section 58 an outlet portion 60 positioned between first cylindrical end portion 56 and central section 58, and a piston spring guide 62 that serves as a stop member. Extending through first cylindrical end portion 156 and terminating at outlet portion 60 is a flow passageway 64 that opens into a cross-bore 70. Passageway 64 has an inlet 65 positioned adjacent to screen assembly 26 to permit refrigerant to flow through expansion valve assembly 16.

Adjacent to and downstream of cross-bore 70 is central section 58. Central section 58 further includes generally cylindrical first and second sections 72 and 74 separated by a metering portion 76. Metering portion 76 has a straight section 78 and a tapered section 80 that is tapered to a predetermined angle.

Figure 4:
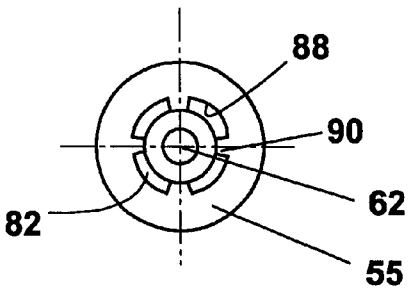
FIG. 4 is a cross sectional view of the variable flow area refrigerant expansion device taken along line B—B in FIG. 2.

A spring chamber 82 is provided within valve body 24, downstream of piston 28. Spring chamber 82 receives spring member 31 to counteract piston 28 movement due to a pressure differential across piston 28. An integral extension member 84 extends inwardly into spring chamber 82 from a distal end 86 of valve body 24 and serves as a stop member that cooperates with piston spring guide 62 of central section 58. Spring member 31 is positioned within spring chamber 82 on with one end engaged with piston spring guide 62 and the other end engaged with extension member 84. Spring member 31 is preferably a calibrator compression spring although other suitable spring members may be used. To permit debris and dirt to escape from spring chamber 82, an interior surface 88 of spring chamber 82 is provided with piston vane members 90, as best seen in FIG. 4.

In accordance with one aspect of the invention, when piston 28 is positioned within valve body 24, central section 58 is positioned within a flow chamber 92 defined by an interior surface 94 of valve body 24. Interior surface 94 has a tapered portion 96 and a straight portion 98 that cooperates with tapered section 80 and straight section 78 of metering portion 76 of piston 28 to meter fluid through expansion valve assembly 16. Preferably, tapered portion 96 is tapered at a second predetermined angle relative to the predetermined angle of tapered section 80 of metering portion 76 so as to provide a sufficiently long orifice tube length when piston 28 moves downstream toward distal end 86 until piston spring guide 62 abuts extension member 84.

Figure 2:
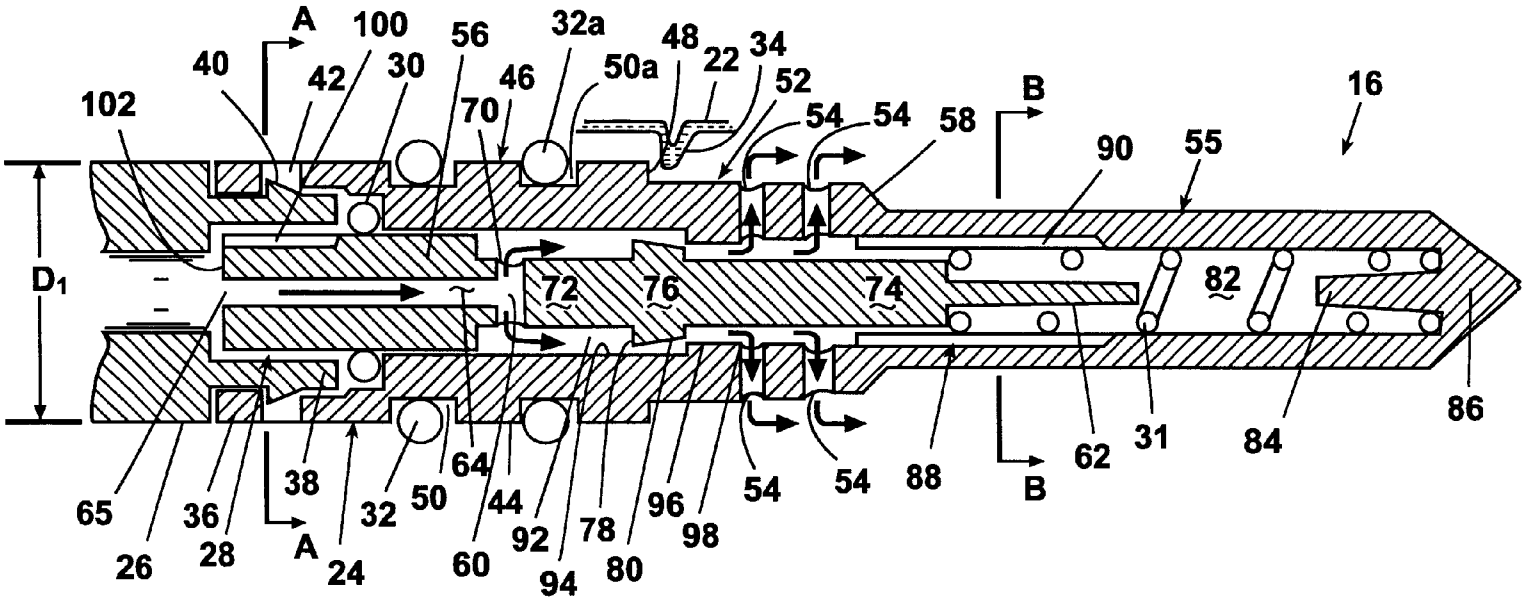
FIG. 2 is a cross sectional view of a variable flow area refrigerant expansion device with a re-open feature in accordance with the present invention.
Figure 3:
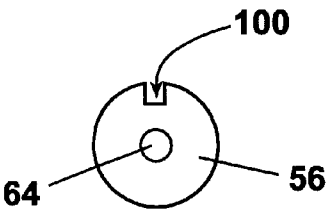
FIG. 3 is a cross sectional view of the variable flow area refrigerant expansion device taken along line A—A in FIG. 2.

In accordance with another aspect of the invention, first cylindrical end portion preferably further includes a flow channel 100, as seen more clearly in FIGS. 2 and 3. Flow channel 100 extends inwardly from an inlet end 102 of piston 28, a predetermined distance such that as piston is moves toward distal end 86 of valve body 24, flow channel 100 moves past sealing member 30 to increase the flow area of the upstream portion of piston 28.

During system operation, piston 28 is positioned in an open position, with piston 28 being displaced fully leftward such that piston spring guide 62 and extension member 84 are spaced away from one another. Refrigerant flows through screen assembly 26 as shown by flow arrows in FIG. 2, and is forced to enter flow passageway 64 due to piston sealing member 30 that is positioned inboard of flow channel 100. Once within flow passageway 64, refrigerant exits piston 28 through cross-bore 70, located upstream of central section 58. Refrigerant then flows between central section 58 and interior surface 94, with metering portion 76 cooperating with interior surface 94 to meter through valve body 28 through flow apertures 54. In accordance with the invention, refrigerant exits through flow apertures 54 with piston 28 staying relatively stationary until the inlet pressure of piston 28 exceeds a predetermined pressure. Above the predetermined pressure, piston 28 moves toward distal end 86, bringing tapered section 80 of metering member 76 adjacent to tapered section 96 of interior surface 94 of valve body. Due to this action, the clearance between an outer surface of metering member and interior surface 94 of valve body 24, is progressively reduced, thereby resulting in a reduction of effective orifice size. When straight section 78 is radially proximate to straight section 98 of valve body 28 interior surface 94, the clearance between these surfaces defines the minimum orifice size of expansion device 16.

As piston 28 moves toward distal end 86 of valve body 24, flow channel 100 moves past sealing member 30. This movement increases the flow area of the upstream portion of flow channel 92 by putting flow channel 100 in parallel to flow passageway 64. However, the increased flow area at inlet end 102 of piston 28 has an insignificant effect on minimum orifice size as the clearance between metering member 76 and valve body 24 interior surface 94 defines the orifice size.

Figure 5:
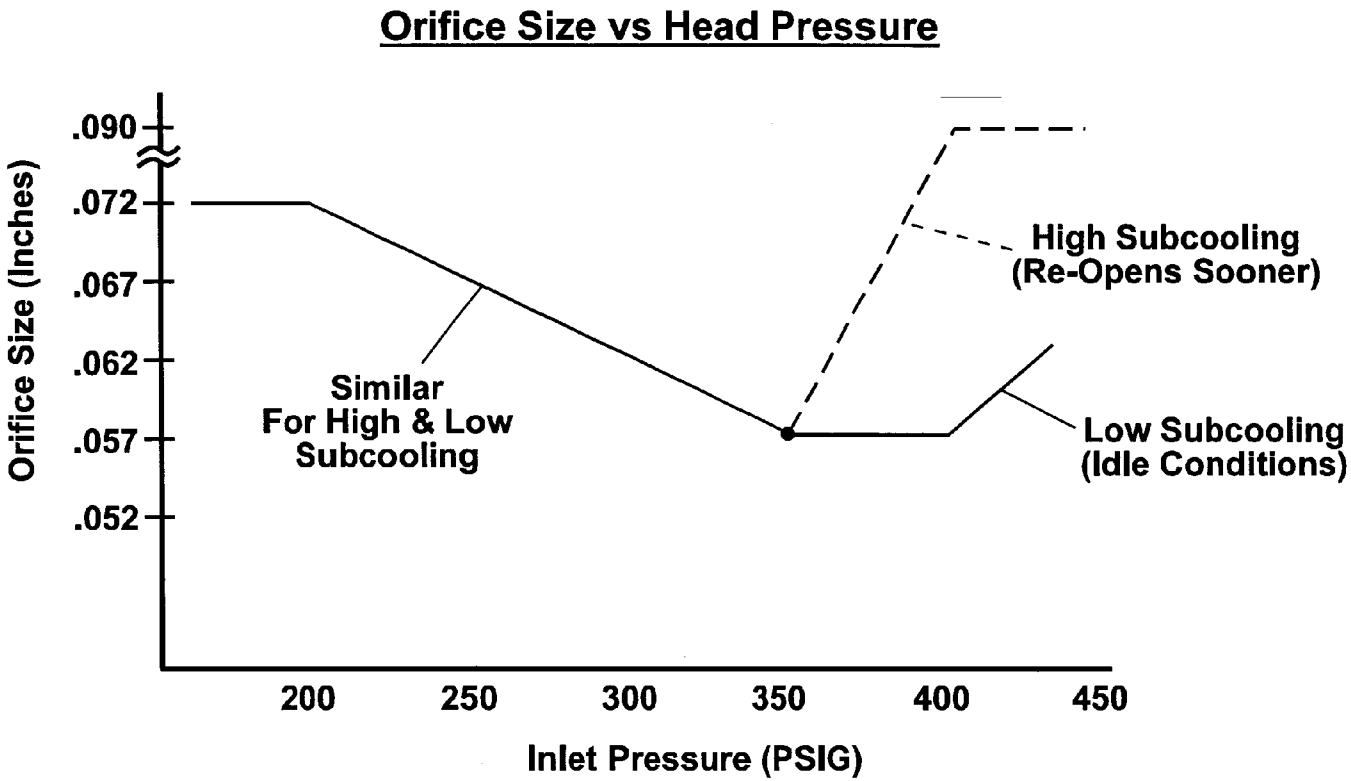
FIG. 5 is a graphical representation of the variable flow area refrigerant expansion device orifice size vs. head pressure.

In accordance with one aspect of the invention, as piston 28 continues to move toward distal end 86. A re-open, or increase in orifice size occurs when the straight section 78 of metering member 76 moves past straight section 98 of interior surface 94, thus unrestricted flow through apertures 54 is permitted. Thus, the controlling orifice size becomes the combination of flow channel 100 and flow passageway 64. The effects of the orifice size v. the inlet pressure, including the re-open feature are illustrated in FIG. 5. Note that high sub-cooling lowers the inlet pressure at which re-open occurs as compared to low sub-cooling as at idle conditions.

Figure 6:
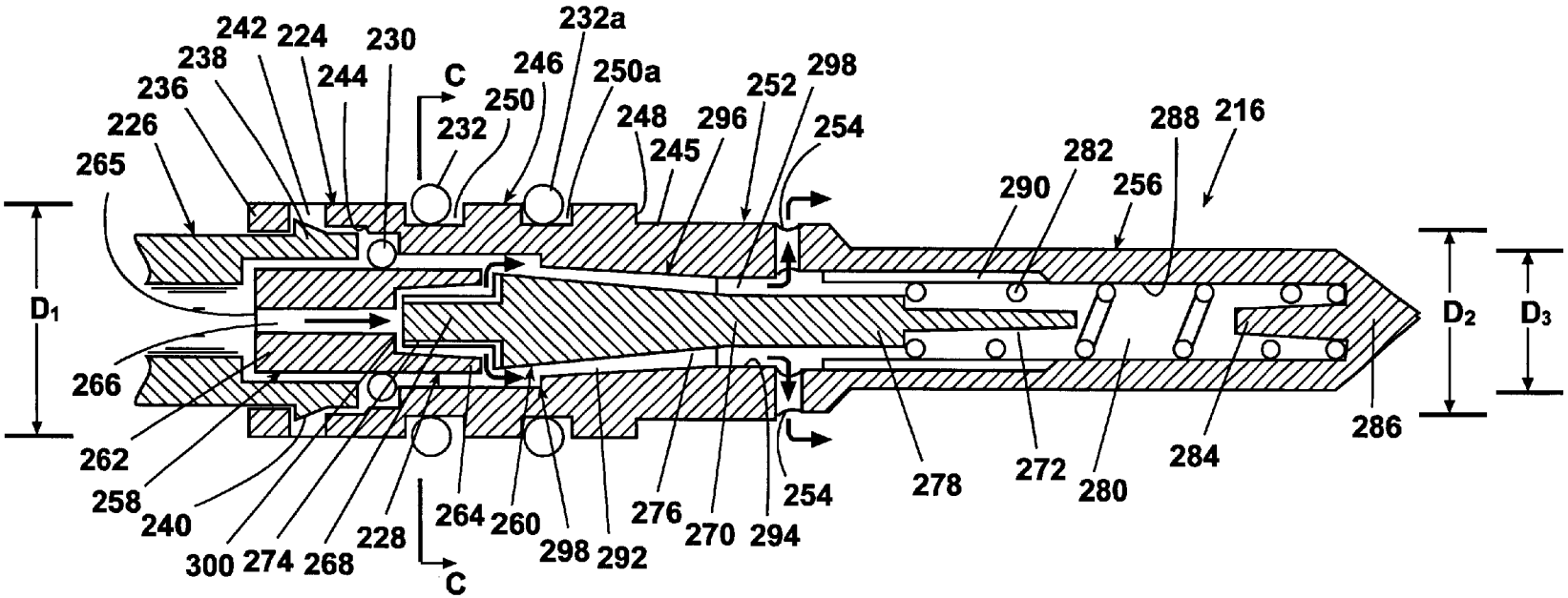
FIG. 6 is an alternative embodiment of a variable flow area refrigerant expansion device having a two-piece piston assembly.
Figure 7:
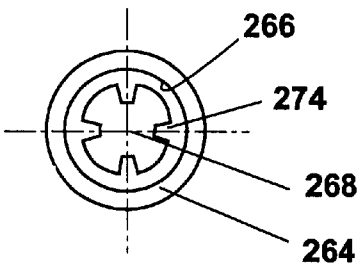
FIG. 7 is a cross sectional view of the variable flow area refrigerant expansion device taken along line C—C in FIG. 6.
Figure 8:
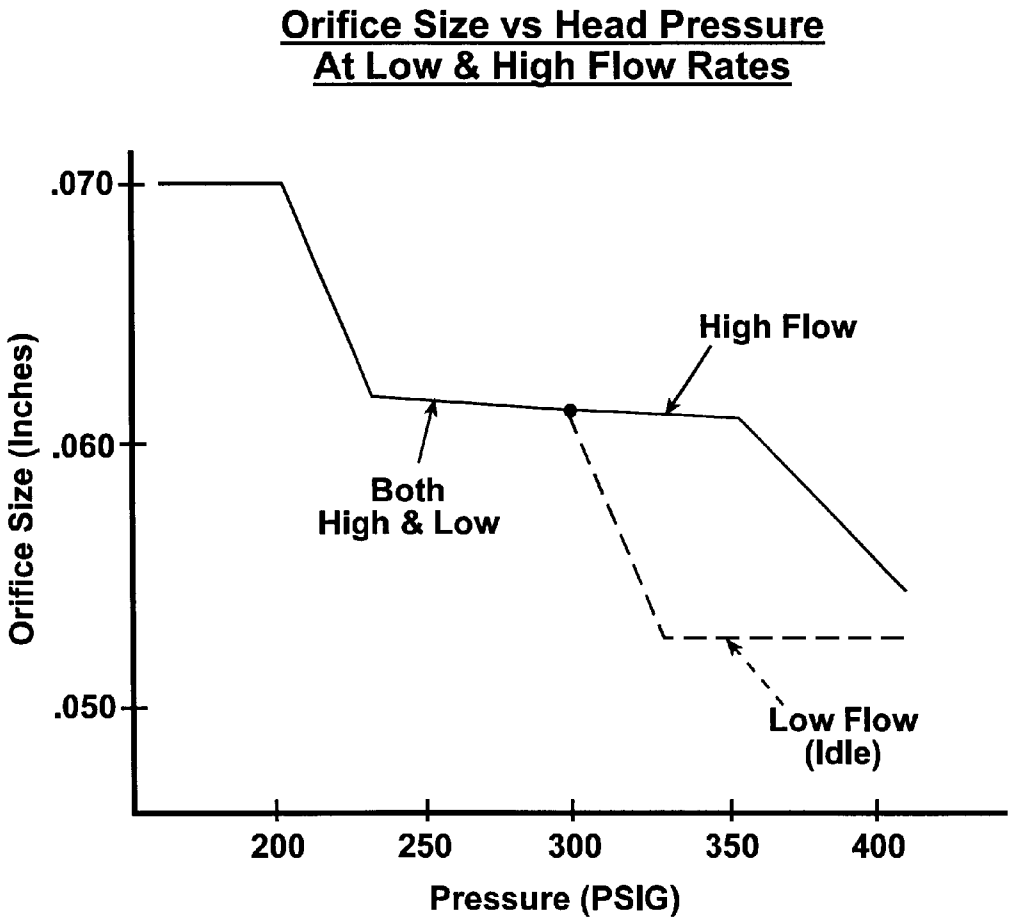
FIG. 8 is a graphical representation of the variable flow area refrigerant expansion device of FIG. 6 depicting orifice size vs. head pressure at low and high flow rates.

FIGS. 6–8 illustrate an alternative embodiment of an expansion device 216. Similar to expansion device 16, expansion device 216 includes a valve body 224, a screen assembly 226, a piston assembly 228, a piston sealing member 230, and at least one expansion device sealing member 232. Screen assembly 226 is positioned at and operatively connected to an inlet end 236 of valve body 224 by means of an annular snap-fit end portion 238. End portion 238 includes an upwardly extending tang member 240 that engages an annular groove 242 formed within an interior surface 244 of valve body 224.

Valve body 224 is generally hollow with a cylindrical outer surface 245. In the preferred embodiment, valve body 224 has stepped sections with varying outer diameters. A first section 246 at inlet end 236 has the largest diameter $D_1$ that is sized to fit within line 22 and is open to receive piston assembly 228. First section 246 terminates at annular surface 248 that abuts against crimped portions (not shown) of line 22 to retain valve body 224 within line 22. Outer surface 245 of first section 246 includes at least one annular groove 250 formed therein to receive expansion sealing member 232. Preferably, sealing member 232 is an O-ring, although other suitable sealing members may be employed. To insure against refrigerant flowing around expansion device sealing member 232, in the preferred embodiment there is a second expansion device sealing member **232*a* positioned within a second annular groove 250*a* downstream of sealing member 232**.

Adjacent first section 246 of valve body 224 is a second section 252. Second section 252 has a second diameter $D_2$ that is smaller than diameter $D_1$ and includes flow channels 254 formed therethrough, to be explained in further detail below. Opposite first section 246 and adjacent second section 252 is an elongated third section 256. Third section 256 has a diameter $D_3$ that is smaller than first and second diameters $D_1$ and $D_2$ of first and second sections, respectively.

Piston assembly 228 is movably positioned within valve body 224. In accordance with the invention, piston assembly 228 has a first piston member 258 and a second piston member 260. First piston member 258 includes a cylindrical entry end portion 262 and a U-shaped exit end portion 264. Extending through first piston member 258 is a flow passageway 266 that has an inlet 265 positioned adjacent to screen assembly 226. Flow passageway 266 widens towards exit end portion 264.

Second piston member 260 includes mating end 268 that is selectively receivable within U-shaped exit end portion 264, an elongated tapered end portion 270 and a piston spring guide 272. Mating end portion 268 further includes flow channels 274, as best seen in FIG. 7. Flow channels 274 extend inwardly from an mating end 268, a predetermined distance to permit refrigerant to flow into valve body 224 around second piston member 260.

Elongated tapered end portion 270 has a first outer surface 276 that is preferably tapered to a first predetermined angle that transitions to a cylindrical end portion 278. Extending from cylindrical end portion 278 is piston spring guide 272 that serves as a stop member.

Third section 256 of valve body 224 further includes a spring chamber 280 positioned therein. Spring chamber 280 receives a spring member 282 to counteract piston assembly 228 movement due to a pressure differential across piston assembly 228. An integral extension member 284 extends inwardly into spring chamber 280 from a distal end 286 of valve body 224 and serves as a stop member that cooperates with piston spring guide 272. Spring member 282 is positioned within spring chamber 280 with one end on piston spring guide 272 and the opposite end on extension member 284. Spring member 282 is preferably a calibrated compression spring although other suitable spring member may be used. To permit debris and dirt to escape from spring chamber 280, an interior surface 288 of spring chamber 280 is provided with piston vane members 290.

In accordance with one aspect of the invention, when piston assembly 228 is positioned within valve body 224, second piston member 260 is positioned within a flow chamber 292 defined by an interior surface 294 of valve body 224. Interior surface 294 preferably has a tapered portion 296 and a straight portion 298 that cooperates with tapered section 270 of second piston member 260 to meter fluid through expansion valve assembly 216. Preferably, tapered portion 296 is tapered at a second predetermined angle relative to the predetermined angle of tapered section 270 of second piston member 260 so as to provide a sufficiently long orifice tube length when piston assembly 228 moves downstream toward distal end 286 of valve body 224.

In accordance with another aspect of the invention, flow chamber 292 is provided with an annular shoulder 298. Annular shoulder 298 serves to restrict the movement of first piston member 258 when end portion 264 is pushed into contact with annular shoulder 298 in response to a predetermined pressure.

During system operation, piston assembly 228 is positioned in an open position, with first piston member 258 being displaced fully leftward such that entry end portion 262 is positioned in general alignment with inlet end 236 of valve body 224. Second piston member 260 is positioned within U-shaped exit end portion 264 with mating end 268 abutting an annular shoulder 300. Refrigerant flows through screen assembly 226 as shown by flow arrows in FIG. 6, and is forced to enter flow passageway 266 due to piston sealing member 230. Once within flow passageway 266, refrigerant flows through flow channels 274 to piston assembly 228. Refrigerant then flows between tapered end portion 270 and interior surface 266 of valve body 224, with tapered end portion 270 cooperating with interior surface 266 to meter through valve body 224 through flow apertures 254.

In accordance with the invention, first and second piston member 258 and 260, respectively, move toward distal end 286 of valve body 224 until exit end 264 of first piston member 258 abuts annular shoulder 298. Next, second piston member 260 splits apart from first piston member 258, continuing traveling toward distal end 286. Accordingly, second piston member 260 is flow sensitive moving at a predetermined inlet pressure when refrigerant flow is at idle conditions when refrigerant flow is low.

In accordance with one aspect of the invention, above the predetermined pressure, second piston member 260 moves toward distal end 286 of valve body 224, moving tapered surface 276 of second piston member 260 along tapered interior surface 294 of valve body 224. Due to this action, the clearance between an outer surface 276 of second piston member 260 and interior surface 294 of valve body 224 is progressively reduced, thereby resulting in a reduction of effective orifice size to meter fluid through flow channels 252. As illustrated in FIG. 8, the pressure differential across second piston member 260 is significantly increased at low refrigerant flow rates as compared to high flow rates. This action is due to flow passageway 266 of first piston member 258 exhibiting a reduced pressure drop at low flow versus high flow. Further, the pressure at cylindrical end portion 278 of second piston member 260 increases at high flow rates, thereby producing a lower pressure differential across second piston member 260 at high flow rates, such as when the vehicle is traveling at highway speeds. Thus, expansion device 216 achieves desirable larger orifice size at high flow rates.

Figure 9:
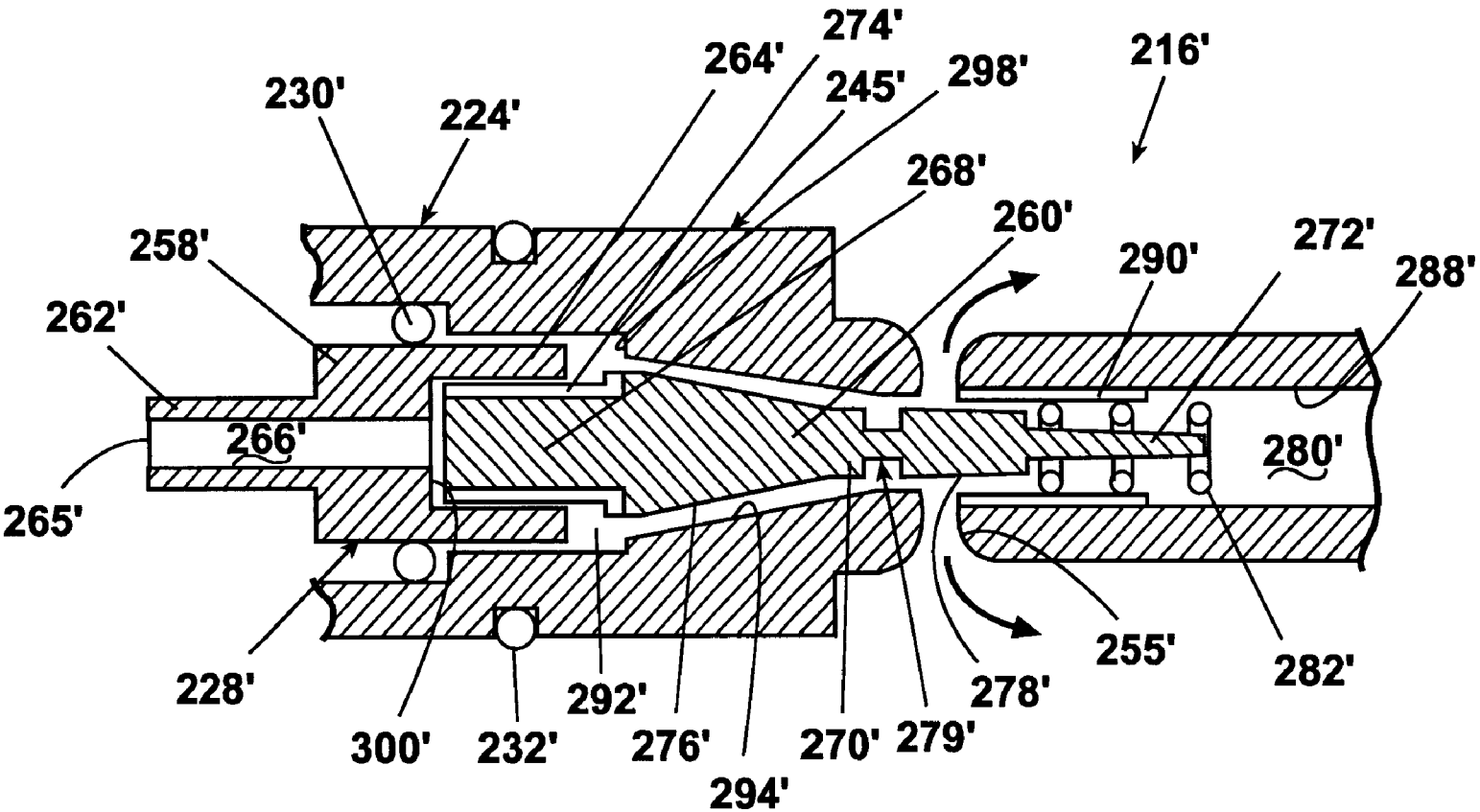
FIG. 9 is a cross-sectional view of an alternative embodiment of a two-piece piston assembly.

FIG. 9 is an alternative embodiment of a two-piece valve assembly 216'. Piston assembly 216' is substantially identical to piston assembly 216 and includes a valve body 224', a screen assembly (not shown), a two piece piston assembly 228', a piston sealing member 230' and at least one expansion device sealing member 232'. Valve boy 224' is generally hollow with a generally cylindrical outer surface 245'. In the preferred embodiment, valve body 224' has stepped section with varying outer diameters, similar to valve body 224. Valve body 224' further includes flow apertures 254' that extend from an interior chamber of valve body 224' to outside of valve body 224' to deliver fluid through valve body 224', as will be explained in further detail below. Preferably, flow apertures 254' are aligned with one another and have radiused outer edges 255' to provide a smooth flow of fluid and reduce noise.

In accordance with the invention, piston assembly 228' is movably positioned within valve body 224'. Piston assembly 228' has a first piston member 258' and a second piston member 260'. First piston member 258' includes a cylindrical entry end portion 262' and a U-shaped exit end portion 264'. Extending through first piston member 258' is a flow passageway 266' that has an inlet 265'. Flow passageway 266' widens towards exit end portion 264'.

Second piston member 260' includes mating end 268' that is selectively receivable within U-shaped exit end portion 264', an elongated tapered end portion 270' and a piston spring guide 272'. Mating end portion 268' further includes flow channels 274', similar to flow channels 274 in piston assembly 216.

Elongated tapered end portion 270' has a first outer surface 276' that is preferably tapered to a first predetermined angle that transitions to a cylindrical end portion 278'. Cylindrical end portion 278' further includes an inwardly extending flow groove 279, to be explained below in further detail. Extending from cylindrical end portion 278' is piston spring guide 272' that serves as a stop member.

Valve body 224' further includes a spring chamber 280' positioned therein. Spring chamber 280' receives a spring member 282 to counteract piston assembly 228' movement due to a pressure differential across piston assembly 228'. Spring member 282' is preferably a calibrated compression spring although other suitable spring member may be used. To permit debris and dirt to escape from spring chamber 280', an interior surface 288' of spring chamber 280' is provided with piston vane members 290'.

In accordance with one aspect of the invention, when piston assembly 228' is positioned within valve body 224', second piston member 260' is positioned within a flow chamber 292' defined by an interior surface 294' of valve body 224'. Interior surface 294' preferably is tapered to cooperate with tapered section 270' of second piston member 260' to meter fluid through expansion valve assembly 216'. Preferably, tapered portion 296' is tapered at a second predetermined angle relative to the predetermined angle of tapered section 270' of second piston member 260' so as to provide a sufficiently long orifice tube length when piston assembly 228' moves downstream toward a distal end of valve body 224'.

In accordance with another aspect of the invention, flow chamber 292' is provided with an annular shoulder 298'. Annular shoulder 298' serves to restrict the movement of first piston member 258' when end portion 264' is pushed into contact with annular shoulder 298' in response to a predetermined pressure.

During system operation, piston assembly 228' is positioned in an open position, with first piston member 258' being displaced fully leftward such that entry end portion 262' is positioned in general alignment with inlet end 236' of valve body 224'. Second piston member 260' is positioned within U-shaped exit end portion 264' with mating end 268' abutting an annular shoulder 300'. Refrigerant flows through screen assembly and is forced to enter flow passageway 266' due to piston sealing member 230'. Once within flow passageway 266', refrigerant flows through flow channels 274' to piston assembly 228'. Refrigerant then flows between tapered end portion 270' and interior surface 294' of valve body 224', with tapered end portion 270' cooperating with interior surface 266' to meter through valve body 224' through flow apertures 254'.

In accordance with the invention, first and second piston member 258' and 260', respectively, move toward distal end 286' of valve body 224' until exit end 264' of first piston member 258' abuts annular shoulder 298'. Next, second piston member 260' splits apart from first piston member 258', continuing traveling toward the distal end of valve body 224'. In accordance with the invention, flow groove 279 aligns with flow apertures 254'. Due to the greater clearance between flow apertures 254' and second piston member 260', the pressure is reduced on the downstream side of tapered end portion 270'. The reduced pressure results in further movement of second piston member 260' at lower inlet pressures as compared to expansion valve assembly 216. Accordingly, flow groove 279 causes lower inlet pressure actuation of second piston member 260' without any significant disengagement inlet pressure because when second piston member 260' is moved into the closed position, flow groove 279 is not aligned with flow apertures 254'.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

I claim:

1. A variable flow area refrigerant expansion device for controlling fluid flow having variable fluid pressure, comprising:

a valve body having an axially extending aperture partially extending therethrough, said aperture including an inlet end and at least one flow aperture, wherein a portion of an inner surface of said valve body terminates in said at least one flow aperture;

a piston slidably received in said aperture of said valve body, said piston having a flow passageway partially extending therethrough, said flow passageway having an inlet and an outlet end, wherein said outlet end terminates in a cross-bore formed through said piston;

wherein said piston includes a metering member having a tapered section and a straight section positioned downstream from said cross-bore, said tapered portion having a first end defined by a first diameter and second end defined by a second diameter, wherein said first diameter of said tapered section is greater than said second diameter of said tapered section; and a spring member operatively connected to said piston to resiliently urge said piston in a first predetermined direction.

2. The variable flow area refrigerant expansion device of claim 1, further including a seal member operatively connected to said piston to direct fluid to flow through said fluid passageway.

3. The variable flow area refrigerant expansion device of claim 1, wherein said piston further includes a flow channel formed on said inlet end of said piston, said piston being selectively movable towards a distal end of said valve body such that said flow channel directs fluid into said expansion device in response to a predetermined inlet pressure.

4. The variable flow area refrigerant expansion device of claim 1, wherein said tapered and straight sections of said metering member cooperate with tapered and straight sections of said inner surface of said valve body to meter fluid through said flow channels formed in said valve body.

5. The variable flow area refrigerant expansion device of claim 4, wherein said tapered section of said valve body generally aligns with said tapered section of said piston to meter fluid through said at least one flow aperture.

6. The variable flow area refrigerant expansion device of claim 4, where in said tapered section of said piston is at a first predetermined angle and said tapered section of said valve body is at a second predetermined angle.

7. The variable flow area refrigerant expansion device of claim 1, wherein said valve body includes at least two flow apertures, said flow apertures being generally aligned with one another.

8. The variable flow area refrigerant expansion device of claim 1, further including a screen assembly connected to said inlet end of said valve body.

9. The variable flow area refrigerant expansion device of claim 3, wherein said flow channel extending inwardly from said inlet end of said piston and is substantially parallel to said flow passageway.

10. A variable flow area refrigerant expansion device for controlling fluid flow having variable fluid pressure, comprising:

a valve body having an axially extending aperture partially extending therethrough, said aperture including an inlet end and at least one flow aperture, wherein a portion of an inner surface of said valve body is tapered from a first diameter to a second diameter and terminates in said at least one flow aperture, wherein said first diameter is larger than said second diameter;

a piston having first and second piston members, said piston slidably received in said aperture of said valve body;

wherein said first piston member has a flow passageway extending therethrough, said flow passageway having an inlet end an outlet end, wherein said outlet end has a diameter larger than the diameter of said inlet end;

wherein said second piston member includes a mating end that is selectively receivable within said outlet end of said flow passageway and an elongated tapered end portion that terminates in a generally cylindrical end portion; and a spring member operatively connected to said piston to resiliently urge said piston in a first predetermined direction.

11. The variable flow area refrigerant expansion device of claim 10, wherein said mating end of said second piston member further includes at least one integral flow channel formed therein.

12. The variable flow area refrigerant expansion device of claim 10, wherein an interior surface of said valve body further includes an annular shoulder to restrict movement of said first piston member relative to said second piston member within said valve body.

13. The variable flow area refrigerant expansion device of claim 10, further including an inwardly extending flow groove formed within said cylindrical end portion of said second piston member.

14. The variable flow area refrigerant expansion device of claim 13, wherein said flow groove aligns with said at least one flow channel when said second piston moves within said valve body in response to a predetermined pressure differential.

15. The variable flow area refrigerant expansion device of claim 10, wherein said at least one flow aperture is radiused to reduce noise during operation.

16. The variable flow area refrigerant expansion device of claim 10, further including a screen assembly connected to said inlet end of said valve body.

17. The variable flow area refrigerant expansion device of claim 10, further including a seal member operatively connected to said piston to direct fluid to flow through said fluid.

18. The variable flow area refrigerant expansion device of claim 10, further including a spring chamber formed downstream of said flow aperture, said spring chamber housing said spring member.

19. The variable flow area refrigerant expansion device of claim 18, wherein said valve body further includes piston vane members formed on an interior surface of said valve body, said vane members permitting debris to escape from said spring chamber.

20. The variable flow area refrigerant expansion device of claim 18, wherein said second piston member further includes an outwardly extending piston spring guide that extends into said spring chamber and engages said spring member.

* * * * *

UNITED STATES PATENT AND TRADEMARK OFFICE

CERTIFICATE OF CORRECTION

PATENT NO. : 6,305,414 B1
DATED : October 23, 2001
INVENTOR(S) : Richard C. Kozinski It is certified that error appears in the above-identified patent and that said Letters Patent is hereby corrected as shown below:

Title page,
Item [57], ABSTRACT, delete "having a re-open feature that increases the inlet orifice diameter of the piston"

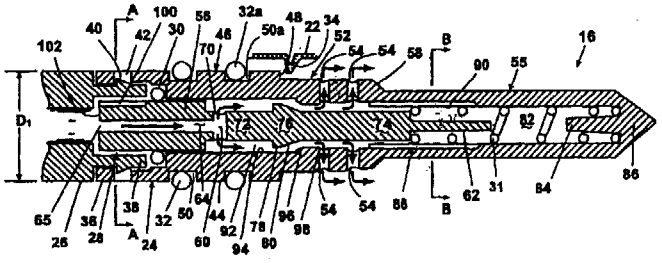

Fig. 2

Signed and Sealed this

Fourteenth Day of May, 2002

*Attest:*

*Attesting Officer*

JAMES E. ROGAN
*Director of the United States Patent and Trademark Office*